US005125887A

United States Patent [19]

Attucci

[11] Patent Number: 5,125,887

[45] Date of Patent: Jun. 30, 1992

[54] DEVICE FOR THE ACCUMULATION OF SHEET MATERIAL ARTICLES DOWNSTREAM OF THE MACHINE WHICH PRODUCES THEM

[76] Inventor: Enrico Attucci, Via di Montauto No. 80, Fraz. Monteoriolo, Impruneta, Firenze, Italy

[21] Appl. No.: 624,395

[22] Filed: Dec. 6, 1990

[30] Foreign Application Priority Data

Aug. 17, 1990 [IT] Italy ..... 9466 A/90

[51] Int. Cl.[5] ..... B65H 29/04

[52] U.S. Cl. ..... 493/204; 493/201; 271/204

[58] Field of Search ..... 493/196, 201, 202, 204; 271/198, 199, 200, 204, 205, 206; 414/751

[56] References Cited

U.S. PATENT DOCUMENTS

| | | | |
|---|---|---|---|
| 3,672,265 | 6/1972 | Schwarzkopf | 271/204 X |
| 4,085,930 | 4/1978 | Weisgerber et al. | 271/204 |
| 4,300,893 | 11/1981 | Achelpohl et al. | 493/204 X |
| 4,487,599 | 12/1984 | Bendig et al. | 493/204 X |
| 4,526,639 | 7/1985 | Reimann | 493/204 X |
| 4,549,877 | 10/1985 | Lehmacher | 493/204 |
| 4,798,573 | 1/1989 | Lacain | 493/204 |

FOREIGN PATENT DOCUMENTS

| | | |
|---|---|---|
| 3631940 A1 | 4/1987 | Fed. Rep. of Germany . |
| 9494 A/85 | 10/1985 | Italy . |

*Primary Examiner*—Bruce M. Kisliuk
*Assistant Examiner*—John A. Marlott
*Attorney, Agent, or Firm*—McGlew & Tuttle

[57] ABSTRACT

Downstream of the welding and cutting bars (14, 16), a crosspiece (18) interacts with two pressure elements (20, 34) which act alternately in order to retain the manufactured articles on said crosspiece, engaging in each cycle the new manufactured article to be accumulated; downstream of said welding bars and said crosspiece, a transporter element (60A), endowed with a movement which corresponds to that of the manufactured article under formation, moves with an active trajectory above the stack under formation (PO) and assists it to extend above the stack under formation; said transporter element (60A) removes itself from below said manufactured article when the latter is engaged by the first pressure element (20).

14 Claims, 5 Drawing Sheets

DEVICE FOR THE ACCUMULATION OF SHEET MATERIAL ARTICLES DOWNSTREAM OF THE MACHINE WHICH PRODUCES THEM

FIELD OF THE INVENTION

The invention relates to a device for the accumulation of bags made of thermoplastic film or similar manufactured articles in order to form them into a uniform stack during their production, comprising welding and cutting bars. The abovementioned device makes it possible to carry out the formation of the stack uniformly and rapidly and without any damage to the manufactured articles which are gradually stacked.

BACKGROUND OF THE INVENTION

According to a prior solution of the assignee of the present application (Italian application no. 9494 A/85 and German application No. P 36 31 940.6), there are provided downstream of said cutting bars: a crosspiece, on which the successive manufactured articles are laid down, two pressure elements acting alternately in order to retain the manufactured articles on the crosspiece, the first of which pressure elements is raised in order to make pass the new manufactured article to be accumulated, while the other pressure element acts on the rear end portion of the manufactured articles of the stack in a sheltered condition below the trajectory of the manufactured article to be accumulated; said first pressure element is lowered in order to act on the stack during a stage of interruption of the advance of a new manufactured article, while said other pressure element is raised in order to receive the rear end portion of the last manufactured article which has just been accumulated and retained by the first pressure element; blowing means are provided in order to favor the positioning and the cooling of the weld of the end of the manufactured article which has just been formed.

SUMMARY OF THE INVENTION

According to the invention, in order to ensure the uniform formation of the stack, the device comprises, downstream of said welding bars, a transporter which is endowed with a movement corresponding to that of the manufactured article under formation and which moves with an active trajectory above the stack under formation and below the advancing manufactured article and assists it in extending above the stack under formation, to then remove itself from below said manufactured article when the latter is engaged by the first pressure element. Said transporter is a transporter with two spaced continuous elements, between which at least one transporter element extends transversely, the transporter being arranged above the surface on which the stack of manufactured articles is formed.

The transporter element or each transporter element can be formed by at least one small bar and better by two small bars, the first of which draws along the manufactured article which is arranged above the small bar, whereas the second small bar acts on the manufactured article and favors its laying down on the stack.

BRIEF DESCRIPTION OF THE DRAWINGS

The invention will be better understood by following the description and the attached drawing which shows a practical non-limitative illustrative embodiment of the invention itself. In the drawing

DETAILED DESCRIPTION OF THE PREFERRED EMBODIMENTS

Figure 1:
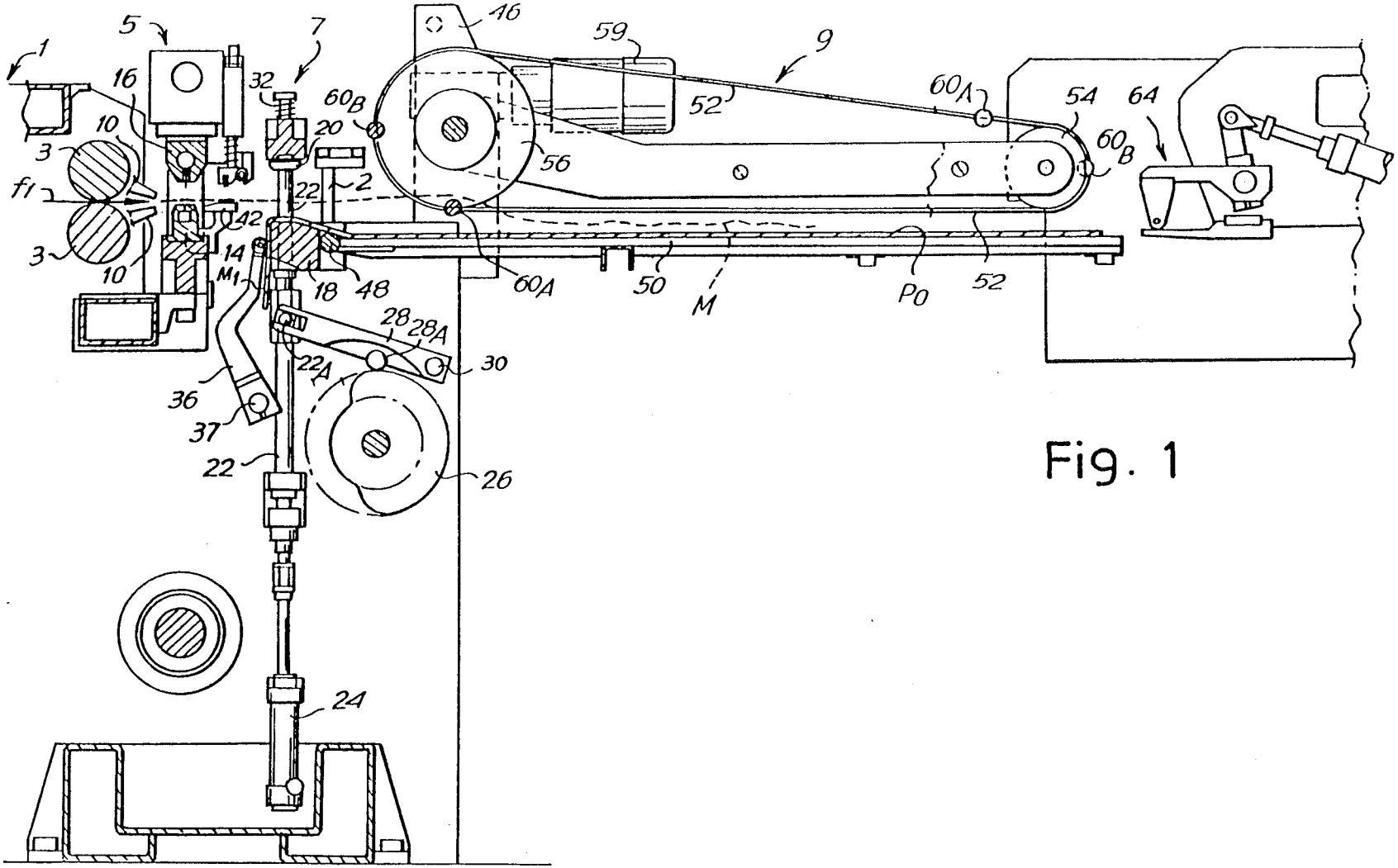
FIGS. 1 and 2 show a diagram of embodiment in longitudinal cross-section in two different positions of the elements for accumulation of the manufactured articles in a stack.

According to what is illustrated in FIGS. 1 to 4, 1 indicates the end part of the machine for continuously producing the manufactured articles which are delivered according to the arrow f1 by a pair of cylinders 3 to a cutting and welding system 5 for the transverse separation and the transverse welding of the manufactured articles. The welding and cutting assembly 5 is followed by an assembly 7 for retention and for accumulation of a stack, which is under formation, of manufactured articles gradually produced by the machine. 9 indicates in a general manner the device which is applied downstream of the assembly 7 in order to facilitate the arrangement of the manufactured articles on the stack under formation, in particular when these are of a certain length and are not easily controllable by means of the usual longitudinal jets of air which accompany the manufactured article during its delivery by the pair of cylinders 3. 10 indicates schematically the nozzles of two rows which with their jets strike the manufactured article M advancing according to the arrow f1 beyond the pair of cylinders 3, these latter possibly being shaped in order to impart to the manufactured article a certain undulation in the transverse cross-section in order to afford a certain longitudinal rigidity to said manufactured article.

The assembly 5 comprises two opposite transverse bars, the lower one of which 14 is fixed whereas the other upper one 16 is vertically movable, being supported by an apparatus which is controlled in its movements by a mechanism known per se; the bar 16 advantageously comprises a cutting blade which is intermediate between two welding ribs which interact with corresponding welding ribs of the lower bar 14, this latter having an intermediate slot for the operation on the part of the blade of the bar 16. This arrangement is also known per se and ensures the cutting and the welding of the edges adjacent to the cut, for the separation and the finishing of the individual manufactured articles which have to be stacked.

The assembly 7 for retention and for accumulation of the individual manufactured articles comprises a crosspiece 18 which is situated in a position slightly below the trajectory which the manufactured article M completes during advancing (assisted by the jets of the nozzles 10). Two pressure elements, which are controlled to operate alternately, interact with this crosspiece 18. An upper pressure element 20 extends correspondingly to the crosspiece 18 and is controlled by shafts 22 which are arranged at the ends and at the bottom are linked to elastic systems 24 which tend to stress them downwards; said shafts are raised by a pair of cams 26, each of which interacts with a tappet 28 with a lever articulated at 30 at one end, which is provided with a roller 28A for contact with the cam 26 and engages with the opposite forked end a peg 22A of the respective shaft 22. By means of this mechanism, the first pressure element 20 can be pressed, by means of springs 32, by the shafts 22 onto the crosspiece 18 in order to press the formed manufactured articles which come to lay down on the latter: the first pressure element 20 is situated above the manufactured articles M which are gradually formed and stacked and presses from the top downwards on the upper surface of the crosspiece 18. Element 2 is attached to crosspiece 18 and adjusts the height of crosspiece 18 and its accompanying mechanisms. The crosspiece is lowered by element 2 in relation to a thickening of the stack of articles. In this way, the stack can thicken in size without interfering with the operation of the pressure elements.

The second pressure element 34 (see FIG. 2) of the assembly 7 is capable of operating cyclically on a lateral wall of the crosspiece 18 which is turned towards the welding and cutting assembly 5; the second pressure element 34 is supported by arms 36 which are articulated at 37 to the fixed structure and controlled in a manner known per se by actuators, for example of the cylinder/piston type or equivalent, which determine the movement of the pressure element 34 against the abovementioned lateral wall of the crosspiece 18 and to move it away from said wall. The second pressure element 34 moves in an interspace which is comprised between the support members of the bar 14 and the crosspiece 18; in the region of this space, above the trajectory of the manufactured articles M, suitably orientated nozzles 38 (see FIG. 3) are provided, which are capable, when activated, of pushing the terminal end of the manufactured article—separated by the welding and cutting system—downwards into said interspace between the bar 14 and the crosspiece 18 for the purposes indicated below. In order to ensure the uniformity of the cutting and of the welding of the manufactured article being acted on by the assembly 5, the latter can be equipped with an additional pressure element 40 (see FIG. 4) which acts on a support structure 42 supported by the support members of the bar 14; this pressure element 40, 42 is active upon the lowering of the apparatus of the bar 16 for cutting and for welding, in order to stabilize the manufactured article during this operation between the pair of cylinders 3 and said additional pressure element.

In the conditions of advance—according to the arrow f1—of a manufactured article under formation which is to be accumulated on the stack under formation PO of the manufactured articles previously formed, the manufactured article M finds space between the crosspiece 18 and the pressure element 20 in the raised condition. The stack PO of the manufactured articles previously formed is laid down with the rear end parts (still with regard to the direction of advance indicated by the arrow f1) of the manufactured articles stacked, which are laid down on the upper surface and on the lateral surface, which is turned towards the assembly 5, of said bar 18; the ends M1 of the stacked manufactured articles are engaged between the crosspiece and the second pressure element 34 which presses on them. When the manufactured article under formation has reached its position in which advance has been carried out and it stops in the conditions in which it has to be welded and cut by the assembly 5, the pressure element 20 is lowered in order to act on the stack under formation PO and thus also on the manufactured article which has just finished advancing, to press the whole on the crosspiece 18. The second pressure element 34 is at this moment moved away from the side of the crosspiece 18 towards the bar 34, leaving space between said crosspiece and the pressure element; when the manufactured article which has just been formed is cut, welded and released from the engagement between the two bars 16 and 14 by the raising of the bar 16, the nozzles 38 are brought into action, which push the rear end M1 of the manufactured article M which has just been formed, drawing it along from the region in which it was situated through the effect of advance until it is against the other ends M1 of the manufactured articles of the stack PO under formation, that is to say along that lateral wall of the crosspiece 18 which faces the assembly 5; when this has been done, the pressure element 34 is brought back to press the ends M1 of the manufactured articles of the stack under formation PO and the first pressure element 20 is raised, as a result of which the advance can be brought about of a successive manufactured article M according to the arrow f1 in order to repeat the operation.

In particular in the case of manufactured articles which are relatively long in the direction of the arrow f1, there is a certain difficulty in the uniform laying down of the manufactured article on the stack PO, at a distance from the crosspiece 18. The assembly 9 according to the invention has been created in order to obtain a uniform laying down even of long manufactured articles on the laying-down surface situated downstream of the crosspiece 18.

According to what is illustrated in FIGS. 1 to 4 of the drawing, the assembly 9 comprises an apparatus 46 articulated about an axis 48 parallel to the crosspiece 18 and adjacent to the latter; the apparatus 46 supports a surface 50 for laying down of the stack PO under formation, and supports, which are lateral in relation to the position of the stack PO and of the manufactured article in the advanced position, for supporting two continuous flexible transporters 52 which are driven round by wheels 54 and 56 respectively, these latter being of greater radius and closer to the assembly 7 and to the assembly 5. The wheels 56 are motive, being driven by a geared-motor assembly 59 supported by the apparatus 46. Between the two continuous flexible elements 52 extend one or two or more pairs of small bars 60 which form the elements for transporting the manufactured article and for its laying down on the surface 50. Normally, one small bar 60 will be provided, or a pair of small bars 60, or two spaced small bars 60 or two pairs of spaced small bars 60, which extend along the continuous flexible elements 52 of the transporter. The lower branch of the flexible elements 52 extends parallel to the laying-down surface 50 and above the latter. The lower active trajectory of one of the transporter elements 60 is situated below the trajectory of the manufactured article M drawn along by the jets of air of the nozzles 10 or in equivalent manner; the movement of the transporter is synchronized in such a manner that, upon the discharge of the material from the assembly 5, the material is inserted above a first small bar 60A of a pair of small bars 60A and 60B and below the second small bar 60B. It follows from this that—whatever the position of the apparatus 46 about the axis 48 may be in order to have the laying-down surface horizontal (FIG. 1) or inclined downwards (FIG. 2)—the manufactured article which is advancing comes to be arranged above the first small bar 60A of the pair of small bars 60A, 60B which are on the point of traveling along the lower active trajectory of the flexible elements 52, as a result of which the manufactured article rests on the small bar 60A, and as the transporter element—constituted by the small bars—is advancing in a direction corresponding to the advance of the manufactured article according to the arrow f1 and preferably at slightly increased speed. it favors the advance of the manufactured article and ensures its uniform laying down on the support surface 50, on the stack PO under formation of manufactured articles; the second small bar 60B is arranged above the material and, upon the advance, favors the laying down of the manufactured article, which is arriving, on and against the stack under formation on the surface 50. At the end of the lower active trajectory of the flexible elements 52, the transporter element releases the front end of the manufactured article which has been made to advance with the aid of these transporter elements and the manufactured article then stops, uniformly laid down on the stack under formation.

Figure 2:
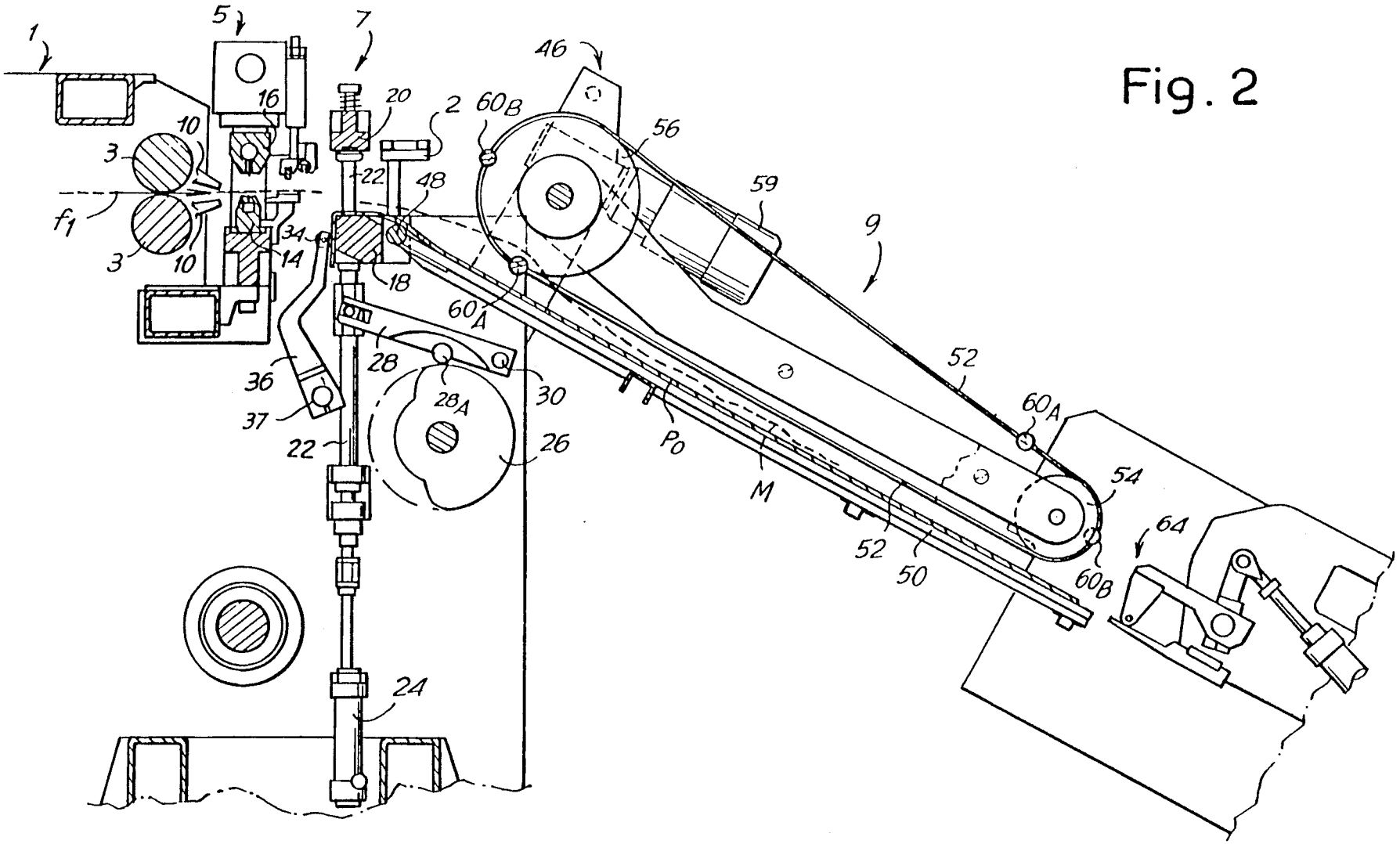
Figure 3:
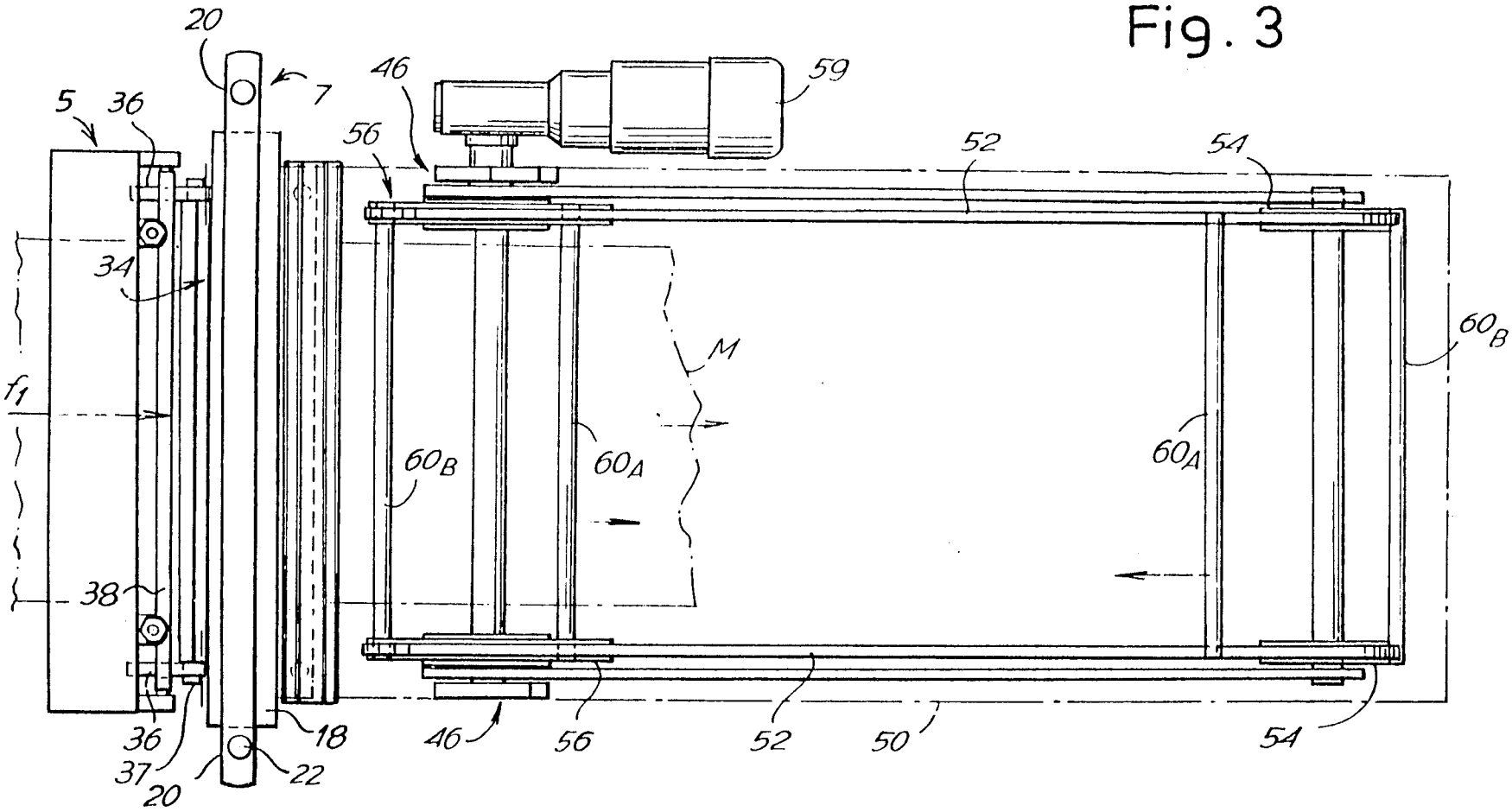
FIG. 3 shows a very schematized plan view.
Figure 4:
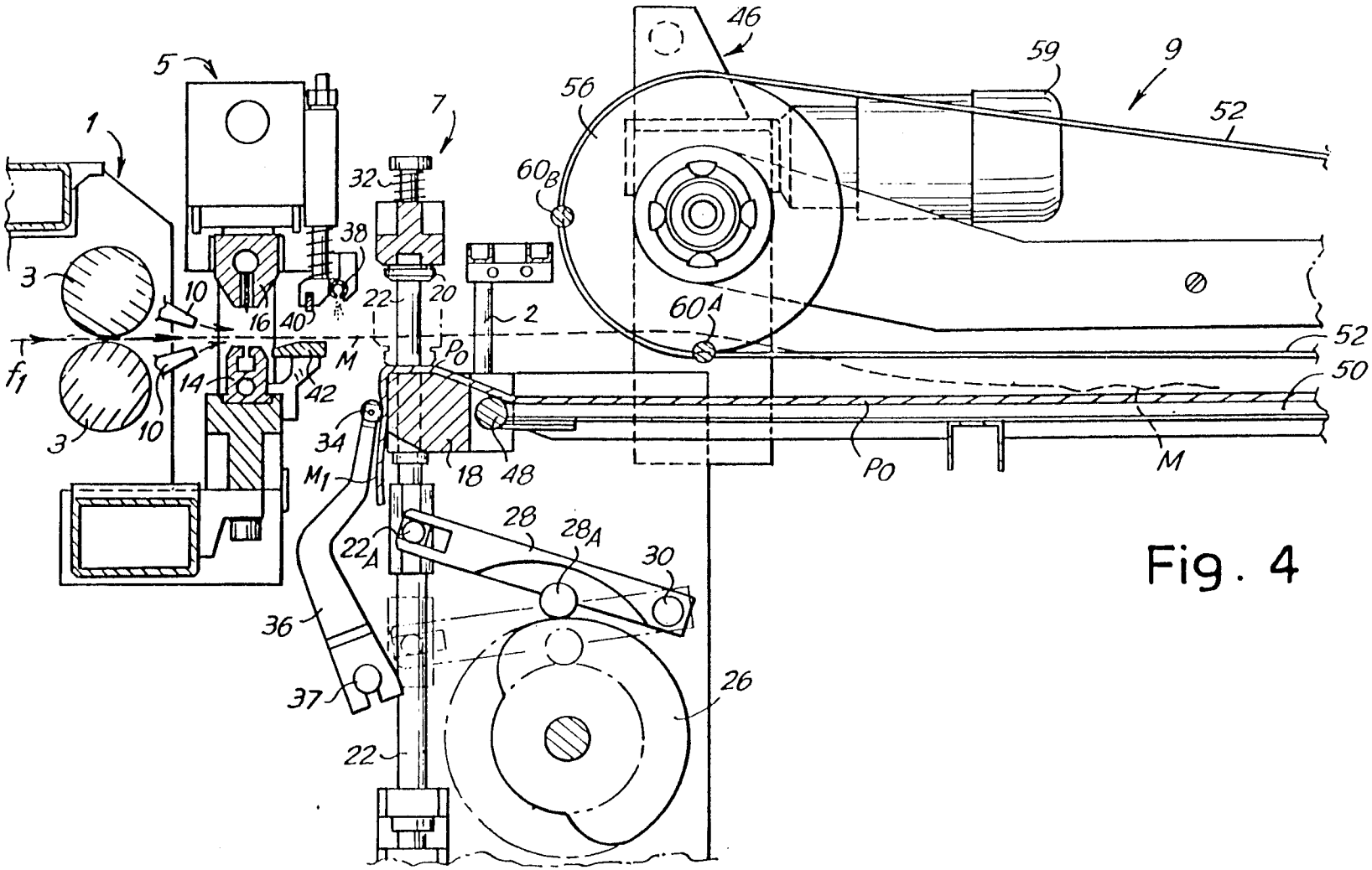
FIG. 4 shows an enlarged detail of FIG. 1, and FIGS. 5, 6 and 7 show alternative embodiments according to the invention.

The movement of the laying-down surface 50 from the position in FIG. 1 to the position in FIG. 2 can be established according to the characteristics of the manufactured article under formation and to the manipulations which have to be carried out subsequently.

For picking up the stack formed, the use of conventional means is envisaged, such as the pincers 64 which engage the stack, which has been formed on the surface 50, by making use of suitable recesses of said surface 50, which leave exposed the thickness of the stack on which the pincers 64 are to act.

Figure 5:
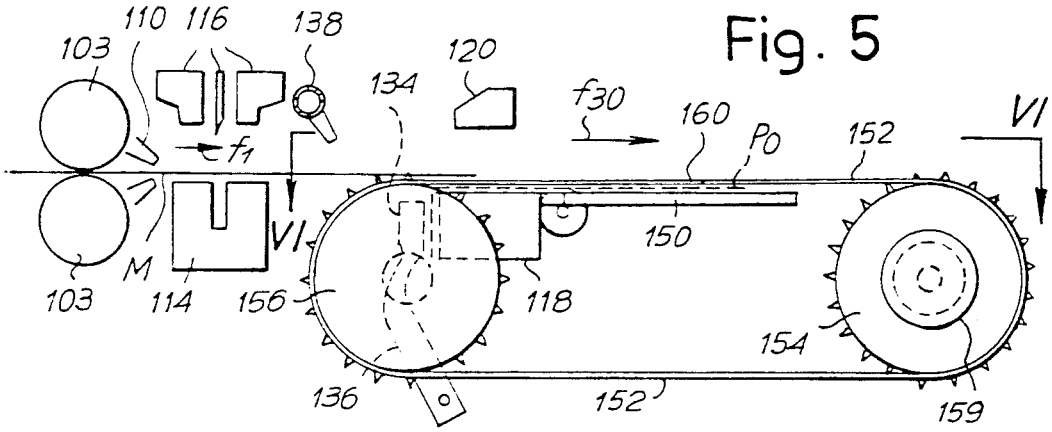
Figure 6:
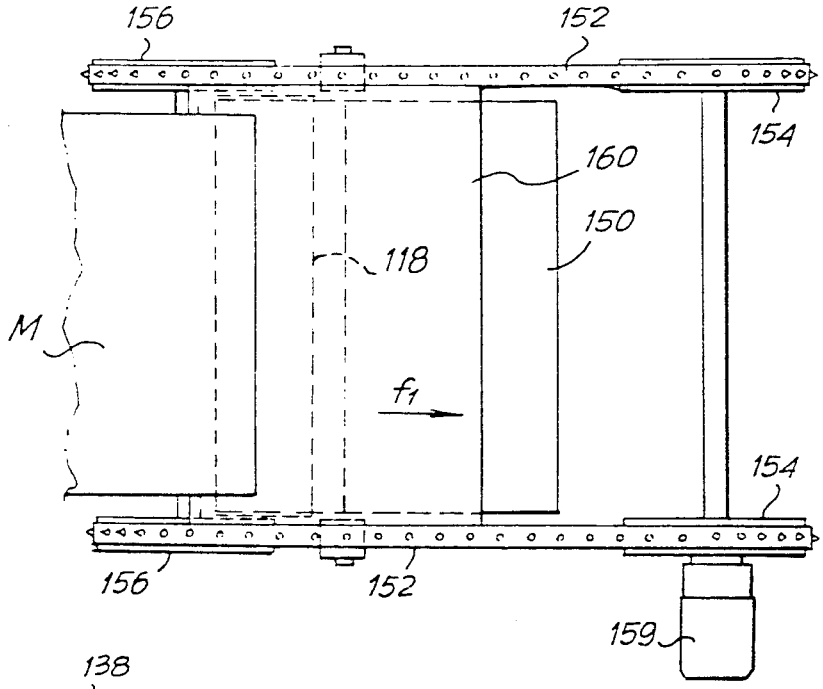
Figure 7:
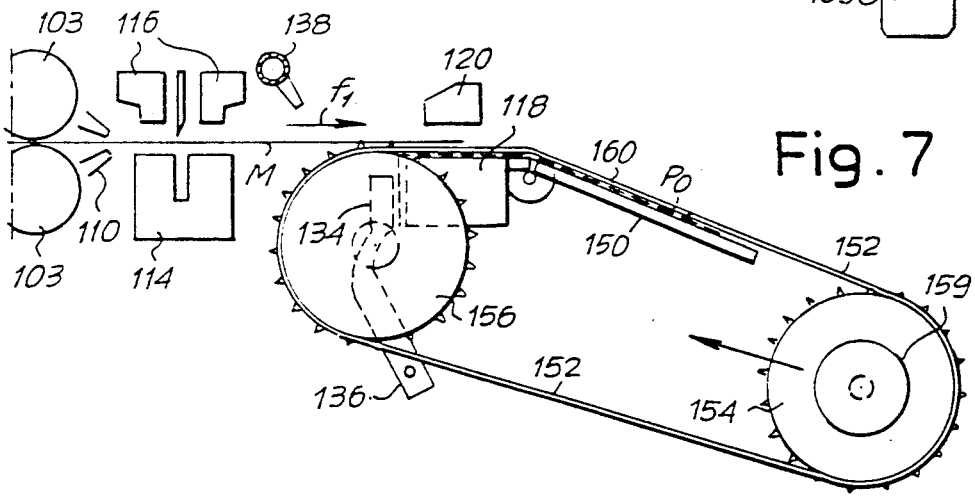

In FIGS. 5, 6 and 7, an alternative embodiment is shown, in which the same components or equivalent components are indicated with the same reference numbers increased by "100". In this embodiment, with reference to FIGS. 5 and 6, two flexible elements of continuous transport 152, driven round between pairs of wheels 154 and 156, are equipped with a transporter element 160 which is developed as a flexible lamina which also follows the curves of the flexible elements 152 along the arcs of return on the wheels 154 and 156. This flexible laminar element 160 is made to run over the crosspiece 118 and over the stack under formation of manufactured articles and the transport of this lamina 160 takes place while the first pressure element 120 is raised and the stacked manufactured articles are retained by the pressure element 134. The manufactured article M under formation is pushed by the jets of the nozzles 110 so as to be situated above the lamina 160 which is situated above the stack under formation PO. Therefore, the advancing lamina 160 favors the extension and the laying down of the manufactured article in the course of formation on the laying-down surface constituted by the stack PO under formation. The first pressure element 120 is lowered after the lamina 160 has run completely over the crosspiece 118 and, after the lowering of the pressure element 120, the moving away of the pressure element 134 takes place in order to arrange the terminal end of the manufactured article under formation on the flank of the crosspiece 118 as in the preceding arrangement.

The alternative in FIG. 7 shows the same solution as in FIG. 5 or 6 but with the shelf 150 inclined and therefore the upper active trajectories of the flexible elements 152 inclined also.

The transporter assembly can be operated at cyclically variable speeds, during each cycle of advance of a manufactured article.

While specific embodiments of the invention have been shown and described in detail to illustrate the application of the principles of the invention, it will be understood that the invention may be embodied otherwise without departing from such principles.

I claim:

1. A device for the welding and stacking of sheet material articles, comprising:

welding and cutting means including welding and cutting bars for welding said articles and cutting said articles and feeding a new sheet material article along a trajectory; support means including a crosspiece positioned downstream of said cutting and welding means for receiving successive sheet material articles; retention means including pressure elements acting alternately in order to retain the sheet material articles on said support means, a first of said pressure elements being raised in order to allow the new sheet material article to pass said first of said pressure elements to accumulate said sheet material articles on said crosspiece, a second of said pressure elements acting on a rear end portion of the new sheet material article at a sheltered location, below the trajectory of the new sheet material article, said first of said pressure elements being lowered to act on the stack after advance of the new sheet material article and said second of said pressure elements being raised in order to receive a rear end portion of the new sheet material article; blowing means for positioning and cooling a weld of an end of the new sheet material article; transporting and positioning means including an element having a movement trajectory above the stack under formation for engaging the new sheet material article while the new sheet material article is being fed by said welding and cutting means, said element moving relative to the new sheet material article and extending the new sheet material article above the stack under formation and subsequently moving from below the new sheet material article after the new sheet material article is engaged by said first pressure element.

2. A device according to claim 1, wherein said transporter means includes two spaced continuous belt elements and a transporter element extending transversely between said two spaced continuous belt elements, said belt elements and said transporter element being arranged above said support means of said stack under formation.

3. A device according to claim 2, wherein at least two spaced transporter elements are provided, the active trajectory of said transporter elements being synchronized to the advance of successive sheet material articles under formation.

4. A device according to claim 2, wherein said transporter element is formed by a bar, extending between said two continuous elements.

5. A device according to claim 2, wherein said transporter element comprises two bars extending between said first and second continuous belt elements whereby in use, a first of said bars acting below said sheet material article and a second of said bars acting above said sheet material article lay said sheet material article down on said stack.

6. A device according to claim 1, wherein said transporter includes two continuous belt elements driven by wheels, said wheels and said belt elements being mutually spaced by an amount which is greater than the width of said sheet material article under formation, said transporter elements having an active portion of a trajectory which corresponds to a lower portion of said continuous flexible transporter belt.

7. A device according to claim 6, further comprising an apparatus forming a surface for laying down a stack of sheet material articles, said apparatus supporting said transporter means and being articulated about a transverse axis adjacent said crosspiece and being movable between a horizontal position and a position inclined downwards.

8. A device according to claim 1, wherein said transporter element includes a laminar surface connected to continuous flexible transporter belts, said transporter belts being spaced apart, said laminar surface having an active trajectory which corresponds to an upper portion of said continuous flexible transporter belts, said laminar element passing over said crosspiece, said laminar element being moved at a rate such that just prior to super position of a front edge of the sheet material article on said cross-piece, said laminar surface, moving in a direction of advance of the sheet material article at a speed which is equal to or slightly greater than that of said advance, is super posed on said crosspiece itself, said front edge of said sheet material article resting for a certain distance on said laminar surface, said laminar surface drawing said sheet material article along to extend said sheet material article as said laminar surface moves relative to said sheet material article for laying said sheet material article on said stack under formation and said sheet material article being released from said laminar surface simultaneously with the lowering of said first pressure element in order to stop said sheet material article relative to said stack, the interposition of said laminar surface on said stack under formation taking place synchronously with the arrival of each sheet material article.

9. The device according to claim 8, wherein said laminar surface comprises a portion of flexible band, said flexible band having a width which is at least equal to that of the width of said sheet material article, a lateral edge of said flexible band being fixed to said continuous flexible transporter.

10. The device according to claim 8, wherein said transporter is connected to motor means for driving said transporter at a rate quicker than the movement of the front edge of said sheet material article as said front edge of said sheet material article is super posed and drawn along by said flexible band and said motor providing a slowed movement to said transporter after said sheet material article has been released, thereby providing synchronization between said super position of a front end of said flexible band above said crosspiece and the movement of said front edge of said sheet material such that said front edge rests on said front end of said flexible band.

11. The device according to claim 1, wherein said transporter means is driven intermittently and includes controlling means for synchronizing movements of said transporter means with the movement of the sheet material articles under formation.

12. The device according to claim 1, wherein progressive lowering of said crosspiece in relation to a thickening of said stack of sheet material articles is provided, said lowering movement involving said second pressure element.

13. A device for the welding and stacking of sheet material articles, the device comprising:

production means including production transporter means for transporting a sheet material article subsequent to a production step;

transporter means including transporter elements movable along an active trajectory above a stack of sheet material articles, said transporter element moving said sheet material article and moving relative to said sheet material article to extend said sheet material article above the stack under formation, said transporter means includes first and second continuous belts driven on transporter wheels, said belts being spaced a distance apart and above said stack under formation and said transporter elements including successive transporter bars extending between said continuous belt elements, said bar elements acting in succession with a first bar being positioned below said sheet material article for extending said sheet material article above said stack under formation and a second of said bars acting above said sheet material article to lay said sheet material article down on said stack under formation as said bar moves relative to said sheet material article; and pressure means for engaging a rear end of said sheet material article to retain said rear end of said sheet material article relative to said stack under formation as said transporter element is removed from below said sheet material article.

14. A device for the welding and stacking of sheet material articles, the device comprising:

production means including production transporter means for transporting a sheet material article subsequent to a production step;

transporter means including transporter elements movable along an active trajectory above a stack of sheet material articles, said transporter element moving said sheet material article and moving relative to said sheet material article to extend said sheet material article above the stack under formation, said transporter means includes first and second continuous belts said first and second continuous belts extending between wheels, said belts being spaced apart a distance above said stack under formation, said transporter elements including a sheet element fixed to each of said first and second continuous belts said sheet element having an active trajectory corresponding to an upper portion of said continuous belts said sheet moving said sheet material article and moving relative to said sheet material article to extend said sheet material article above said stack under formation; and pressure means for engaging a rear end of said sheet material article to retain said rear end of said sheet material article relative to said stack under formation as said transporter element is removed from below said sheet material article.

* * * * *